US005464985A

United States Patent [19]

Cornish et al.

[11] Patent Number: 5,464,985

[45] Date of Patent: Nov. 7, 1995

[54] NON-LINEAR FIELD REFLECTRON

[75] Inventors: Timothy J. Cornish; Robert J. Cotter, both of Baltimore, Md.

[73] Assignee: The Johns Hopkins University, Baltimore, Md.

[21] Appl. No.: 130,530

[22] Filed: Oct. 1, 1993

[51] Int. Cl.[6] ..... H01J 49/40

[52] U.S. Cl. ..... 250/396 R; 250/287

[58] Field of Search ..... 250/396 R, 396 ML, 250/282, 290, 293, 281, 282

[56] References Cited

U.S. PATENT DOCUMENTS 5,168,168 12/1992 McComas et al. ..... 250/287
5,300,774 4/1994 Buttrill, Jr. ..... 250/287

FOREIGN PATENT DOCUMENTS

0551999A1 7/1993 European Pat. Off. .

OTHER PUBLICATIONS

Cornish T. J. and Cotter, R. J., A Curved–field Reflectron for Improved Energy Focusing of Product Ions in Time–of–flight Mass Spectrometry; Rapid Communications in Mass Spectrometry, vol. 7, 1037–1040 (1993).
Shey, K. L. et al., Int. J. Mass Spectrom. Ion Processes (1989), "Ion/Surface Collision Phenomena in an Improved Tandem Time–of–Flight Instrument," vol. 94, pp. 1–14.
Weinkauf, R. et al., Int. J. Mass Spectrom. Ion Proceses, "Laser Tandem Mass Spectrometry in a Time of Flight Instrument," vol. 44a, (1989), pp. 1219–1225.
Wiley, W. C., McLaren, I. H., Rev. Sci. Instrumen. (1955) vol. 26, pp. 1150 to 1157.
Holland, J. F. et al., J. T. Anal. Chem (1983) vol. 55, p. 497A.
Mamyrin, B. A. et al., Sov. Phys. JETP (1973) vol. 37, p. 45.
Tang, X. et al., Int. J. Mass Spectrom. Ion Processes (1988) vol. 85, p. 43.
Grix, R. et al., Rapid Commun. Mass Spectrom, (1988) vol. 2, p. 83.
Della–Negra, S. et al., Anal. Chem. (1985) vol. 57, p. 2035.
Standing, K. G. et al., Anal. Instrumen. (1987) vol. 16, p. 173.
Spengler, B. et al., Rapid Commun. Mass Spectrom, (1992), vol. 6, p. 105.
Jardine, D. R. et al., Org. Mass. Spectrom, (1992) vol. 27, pp. 1077–1083.
Schey, K. L. et al., Int. J. Mass Spectrom. Ion Processes (1987) vol. 77, pp. 49–61.
Strobel, F. H. et al., J. Am. Soc. Mass Spectrom. (1990), vol. 2, pp. 91–94.
Strobel, F. H. et al., Anal. Chem. (1992), vol. 64, pp. 754–762.
Cornish, T. J., Cotter, R. J., Anal. Chem. (1993) vol. 65, p. 1043.
Cornish, R. J., Cotter, R. J., Org. Mass Spectrom (in press).

*Primary Examiner*—Jack I. Berman
*Assistant Examiner*—Kiet T. Nguyen
*Attorney, Agent, or Firm*—Cushman, Darby & Cushman

[57] ABSTRACT

A reflectron capable of focusing an entire mass range of product ions at substantially the same focal point, comprising a plurality of lens plates, each having an opening therein, for generating a non-linear electric field in the reflectron. To generate the non-linear electric field, the voltage applied to each successive lens plate increases non-linearly with respect to its adjacent lens plate. The voltage of the first lens plate having the opening through which the ions first enter the reflectron is set to a low potential and the voltage being applied to each successive lens plate increases in a non-linear manner with the largest voltage being applied to the lens plate furthest from the first lens plate. This non-linear voltage application, to generate the non-linear electric field, can be achieved by coupling a potentiometer between each lens plate and adjusting each potentiometer accordingly. Alternatively, to generate the non-linear electric field, the lens plates may be unequally spaced and an equal voltage may be applied to each lens plate.

18 Claims, 13 Drawing Sheets

NON-LINEAR FIELD REFLECTRON

This invention was made with government support under NIH Grant #R01 GM 33967 awarded by the National Institutes of Health. The government has certain rights in this invention.

BACKGROUND OF THE INVENTION

1. Field of the Invention

The present invention relates to a reflectron for generating a non-linear retarding electrical field to focus product ions, formed in a time-of-flight mass spectrometer or the like, at the same or substantially the same focal point regardless of mass, to enable a detector, disposed substantially at that focal point, to obtain well resolved mass spectra throughout the product ion mass range without scanning, stepping or otherwise changing the voltage of the reflectron.

2. Description of the Related Art

Mass Spectrometers

Mass spectrometers are used to determine the chemical composition of substances and the structures of molecules. In general, they comprise an ion source where neutral molecules are ionized, a mass analyzer where ions are separated according to their mass/charge ratio, and a detector. Various mass analyzers exist, such as, for example, magnetic field (B) analyzers, combined electrical and magnetic field or double-focusing instruments (EB or BE), quadrupole electric field (Q) analyzers, and time-of-flight (TOF) analyzers.

Tandem Mass Spectrometers

Two or more analyzers may be combined in a single instrument to produce tandem (MS/MS) mass spectrometers. These include triple analyzers (EBE), four sector mass spectrometers (EBEB or BEEB), triple quadrupoles (QqQ) and hybrids such as the EBqQ.

In tandem instruments, the first mass analyzer is generally used to select a precursor ion from among the ions normally observed in a mass spectrum. Fragmentation is then induced in a collision chamber located between the mass analyzers, and the second mass analyzer is used to provide a mass spectrum of the product ions.

Tandem mass spectrometers may be utilized for ion structure studies by establishing the relationship between a series of molecular and fragment precursor ions and their products. More commonly today, they are utilized to determine the structures of components of a compound mixture.

For example, the primary structure of a protein is generally determined by digesting the protein with an enzyme, which cleaves at specific amino acids to produce a set of smaller peptides, separating the resultant peptides by chromatography, and determining the amino acid sequence of each peptide. In many cases, the peptides cannot be separated completely. In such cases, a tandem mass spectrometer employing a soft ionization technique (one which produces molecular ions and a few fragment ions) will record a mass spectrum in the first mass analyzer reflecting the molecular weights of the series of peptides in a particular chromatographic fraction. Each of these can be selected as a precursor ion by the first mass analyzer, fragmented in an intermediate collision chamber, and its product ion spectrum recorded in the second mass analyzer to produce a series of peaks that can be used to elucidate the amino acid sequence.

Sector Instruments

In sector instruments (those utilizing electrostatic analyzers and magnetic fields), it is possible to observe product ion mass spectra on a single (two sector) mass analyzer by scanning the magnetic field and electric field simultaneously. An analogous situation, as described below, occurs for time-of-flight mass spectrometers in that product ions may be observed on a single TOF analyzer equipped with a reflectron, as well as on any number of tandem configurations.

A major limitation on the sensitivity of mass spectrometers arises in instruments which must scan the mass range one mass at a time. For this reason, tandem (four sector) instruments have recently been constructed with spatial array detectors, which record ions over a region (typically 4% to 8%) of the spectrum simultaneously. Spatial array detectors cannot be constructed for quadrupole based instruments, since they do not separate ions by spatial dispersion. Time-of-flight mass analyzers, on the other hand, can record ions over the entire mass range simultaneously.

Time of Flight Mass Spectrometers

Time-of-flight mass spectrometers are relatively simple instruments that record the mass spectra of compounds or mixtures of compounds by measuring the times (usually of the order of tens to hundreds of microseconds) for molecular and/or fragment ions of those compounds to traverse a (generally) field-free drift region. The simplest version of a time-of-flight mass spectrometer, as shown in FIG. 1, consists of a short source region S in which ions are formed and accelerated to their final kinetic energies by an electrical field defined by voltages on the backing plate and drawout grid, a longer field-free drift region D, bounded by the drawout grid and an exit grid, and a detector.

In the most common configuration, the drawout and exit grids (and therefore the entire drift length) are at ground potential, the voltage on the backing plate is V, and the ions are accelerated in the source region to an energy: $mv^2/2=eV$, where m=the mass of the ion, v=the velocity of the ion, and e=the charge on an electron. The ions that pass through the drift region and their times of flight as measured by a detector is represented by the following equation:

$$t=\left[\frac{m}{2eV}\right]^{1/2} D \qquad [1]$$

which shows a square root dependence upon mass. Typically, the source distance S is of the order of 0.5 cm, while drift lengths D ranging from 15 cm to 8 meters have been utilized. Accelerating voltages V generally range from 3 kV to 30 kV, and flight times are of the order of 5 to 100 microseconds.

A time-of-flight mass spectrometer described in 1955 by Wiley and McLaren (Wiley, W. C.; McLaren, I. H.: *Review of Scientific Instruments*, Vol. 26, No. 12 (1955) pp. 1150–57) resulted in the first commercial instrument that was produced by the Bendix Corporation. In that instrument, volatile compounds were ionized by a pulsed electron beam (electron impact or EI), extracted by a drawout pulse, and accelerated into a one meter flight tube. The entire mass spectrum could be observed as an oscillographic trace triggered by the drawout pulse.

Alternatively, the spectrum could be recorded by measuring the ion current in a short (10–50 ns) window that was incremented in successive time-of-flight cycles that occurred at a repetition rate of 10 kHz. This boxcar or time slice recording method, as taught by Holland et al. (Holland, J. F.; Enke, C. G.; Allison, J.; Stults, J. T.; Pinkston, J. D.; Newcombe, B.; Watson, J. T.: *Analytical Chemistry* (1983)

Vol. 55, 997A) had two major drawbacks. First, it required that the analog transients produced in repetitive cycles be reproducible. This was feasible for the electron impact ionization of gaseous samples, but would not be practical for current methods involving laser induced ionization of non-volatile samples, which generally produce transients which vary widely from laser shot to laser shot. Secondly, the scanning method that was used to reconstruct a mass spectrum did not take advantage of the multiplex recording capability (i.e. the ability to record ions of all masses simultaneously) of the time-of-flight analyzer. This resulted in considerable reduction in duty cycle and loss of ultimate sensitivity that might be required in modern instruments that are used to examine minute quantities of biological samples.

Linear Time-Of-Flight Mass Spectrometers

Linear time-of-flight mass spectrometers generally have low mass resolution (about one part in 300 to 600), that can be attributed, in part, to the initial kinetic energy distribution of the ions. The Wiley-McLaren instrument sought to improve mass resolution using a method known as time-lag focusing. This approach, which utilized a time delay between the ionization and extraction/acceleration events, was unfortunately mass dependent. It was compatible with boxcar recording in that the length of the time delay could be scanned synchronously. It was not, however, compatible with multiplex recording, since only a portion of the mass spectrum would be in focus.

Because the ions have a finite distribution of kinetic energies that results in poor mass resolution, time-of-flight instruments generally incorporate reflectrons which provide a retarding electrical field that reverses the ion trajectories in order to cancel the effects of kinetic energy distribution on ion arrival time at the detector. When used to focus ions that are formed in the ion source, the focusing effects of the reflectron are independent of mass. That is, a detector located at the focal point can be used to record the entire mass range at maximum resolution in each time measurement cycle.

Reflectrons

The reflectron (or ion mirror) is a device for improving the time focusing of groups of ions at the detector, and hence the mass resolution, by compensating for the initial kinetic energy distributions of the ions within the groups of ions, independent of the mass of the ions formed in the ion source. For example, when ions are formed in an ion source and injected into a time-of-flight mass spectrometer system, ions having different mass/charge ratios (e.g. m/z ratios) have essentially the same final kinetic energy after acceleration and thus travel through the flight tube of the time-of-flight mass spectrometer at different speeds. However, the ions may have slightly different initial kinetic energies. Hence, the reflectron is used to "focus" the ions at the same point within the system, with ions of different mass/charge arriving at that point at different times.

To focus the ions, the reflectron, as shown in FIG. 2, generates a retarding electrical field which decelerates the ions essentially to zero velocity, and causes those ions to turn around and return along essentially the same path in the opposite direction. In practice, the return path is at a small angle with respect to the original flight path in order to physically accommodate the reflected ion detector.

As the ions enter the reflectron, ions with higher kinetic energy (velocity) penetrate the reflectron more deeply than those with lower kinetic energy, and thus travel a longer path to their focal point. Hence, a group of ions (e.g. 500 Da) having an initial kinetic energy distribution (i.e. the ions in the group each have slightly different initial kinetic energies) reach the detector with the same initial kinetic energy distribution, but arrive at the detector at essentially the same time.

A single-stage reflectron, as shown in FIG. 3, provides only a single linear retarding field. In contrast, the reflectron described by Mamyrin et al. (Mamyrin, B. A.; Karatajev, V. J.; Shmikk, D. V.; Zagulin, V. A. Sov. *Phys. JETP* Vol. 37, No. 1 (1973) pp. 45–8) was a dual-stage reflectron. That is: the voltages placed on the stack of ion lenses (as shown in FIG. 2) provided two distinct linear retarding field regions, bounded by grids to minimize field penetration. In this configuration, ions are decelerated to approximately one third of their initial kinetic energies within the first 10% of the reflectron, while the longer second region provides the different path length for ions with different kinetic energies. Thus, a dual-stage configuration enables the reflectron to be much smaller than a single-stage reflectron having an equivalent focal length.

In instruments employing reflectrons, such as time-of-flight mass spectrometers, ions pass through two field-free regions ($L_1$ and $L_2$ as shown, for example, in FIG. 2) and into and out of the reflectron, where they turn around at a distance d which is the penetration depth (the depth that the electron penetrates into the reflectron). In instruments incorporating a single-stage reflectron, the total flight time is represented by the following equation:

$$t=\left[\frac{m}{2eV}\right]^{1/2}(L_1+L_2+4d) \qquad [2]$$

which follows a square root law similar to that of linear instruments. The focusing action can be understood by replacing the denominator in equation [2] with 2 $eV+U_0$, where $U_0$ represents the contribution to the ion velocity from the initial kinetic energy distribution.

Ions with excess kinetic energy spend less time in the linear regions $L_1$ and $L_2$ (whose lengths do not change). However, the penetration depth increases for more energetic ions, so that the value of term d increases, with optimal focusing achieved when $L_1+L_2=4d$, that is, when ions spend approximately equal amounts of time in the field-free and reflectron regions (Tang, X; Beavis, R; Ens, W.; Lafortune, F.; Schueler,B.; Standing, K. *International Journal of Mass Spectrometry and Ion Processes*, Vol. 85 (1988) pp. 43–67). Most importantly, optimal focusing is independent of mass, so that the reflectron voltages, focal point and position of the detector are the same for the entire mass range which can be brought into focus for each time measurement cycle.

Gridless Reflectrons

In addition to the single-stage and dual-stage reflectrons described above, Wollnik et al. (Grix, R.; Kutscher, R.; Li, G.; Gruner, U.; Wollnik, H. *Rapid Communications in Mass Spectrometry*, Vol. 2, No. 5 (1988) pp. 83–5) have described gridless reflectrons, as shown, for example, in FIG. 4, which are designed to minimize the loss of ion transmission due to collisions of ions with grids. While the potentials placed on successive lens elements differ from those that would be used on gridded reflectrons, the intention is to shape a linear deceleration field while compensating for the field penetration that would occur in the absence of the entrance grid. Thus, the gridless reflectron is essential a linear, single-stage device that can additionally provide spatial refocusing of an initially divergent ion beam.

Coaxial Reflectrons

Coaxial reflectrons, as shown, for example, in FIG. 5, have also been described (Della-Negra, S.: LeBeyec, Y. *Anal. Chem.* Vol. 57 (1985) pp. 2035–40), which focus a divergent beam onto an annular channel plate detector located at the exit of the ion source. Both single-stage and dual-stage coaxial reflectrons have been designed, consisting of one or two linear retarding field regions, respectively.

Product Ion Mass Spectra

While reflectrons were initially intended to improve mass resolution for molecular and fragment ions formed in the ion source region, they have more recently been exploited for recording the mass spectra of product ions. This is performed by dissociating precursor ions, formed in the source, into product ions.

The product ions are formed outside the ion source region after acceleration by metastable decay, fragmentation induced by collisions with a target gas, collisions with a surface or by photodissociation. Such processes can be represented by the reaction:

$$m_1 \rightarrow m_2 + n \quad [3]$$

where $m_1$, $m_2$ and n are the masses of the precursor ion, product ion and product neutral, respectively.

The intact precursor ions are recorded at the same flight times as observed in the normal mass spectrum. Product ions have the same velocity as the precursor ions, spend the same time in the field-free regions, and could therefore not be distinguished in instruments without a reflectron. However, because they enter the reflectron with energies equal to $(m_2/m_1)eV$, they penetrate the retarding field of the reflectron to a much shallower depth than do the precursor ions, and have total flight time ($t_2$), corresponding to the equation:

$$t_2 = \left[\frac{m_1}{2eV}\right]^{1/2} \left( L_1 + L_2 + 4\frac{m_2}{m_1} d \right) \quad [4]$$

or, in terms of the flight time of the precursor ion ($t_1 = t_1'' + t_1'$, where $t_1'$ and $t_1''$ are the times spent in the linear and reflectron regions, respectively), corresponding to the equation:

$$t_2 = \left[\frac{m_2}{m_1}\right] t_1'' + t_2' \quad [5]$$

which shows a linear dependence upon mass. Thus, the reflectron serves as a mass dispersive device for product ions.

Focusing can again be understood by replacing the denominator in equation [4] with $eV+U_0$. However, $(m_2/m_1)d$ is smaller than d so that the optimal focal point (where the detector should be positioned, i.e., distance $L_2$ from the reflectron) will be different for each product ion group. Hence, one could adjust the reflection voltage (for each product ion group) to increase the penetration depth d and achieve optimal focusing for a particular ion group.

Product ions will appear in normal mass spectra as generally weak and poorly-focused peaks which cannot be easily associated with a given precursor ion. However, it is possible to record the product ion mass spectrum for a single precursor, by selecting ions of a single mass for passage through the first drift region. An example of this approach is described by Schlag et al. (Weinkauf, R.; Walter, K.; Weickhardt, C.; Boesl, U.; Schlag, E. W.: *Int. J. Mass Spectrom. Ion Processes* Vol 44a (1989) pp. 1219–25), in which an electrostatic gate is located in the first drift region. The ions passed by the gate are then fragmented by photodissociation using a pulsed UV laser, and the product ions are detected after reflection.

An alternative approach was introduced by LeBeyec and coworkers using a coaxial dual-stage reflectron, and has been developed by Standing et al. (Standing, K. G.; Beavis, R.; Bollbach, G.; Ens. W.; LaFortune, F.; Main, D.; Schueler, B.; Tang, X; Westmore, J. B. *Analytical Instrumentation* 16(1) (1987) pp. 173–89) using a single-stage reflectron. In this approach, all ions are permitted to enter the reflectron. A detector is also located at the rear of the reflectron and records neutral species resulting from the metastable decay in the first field-free drift length. Because these neutrals appear at time corresponding to the mass of the precursor ion, it is then possible to only register ions in the reflectron detector when a neutral corresponding to the precursor mass is received. The resultant spectrum, known as a correlated reflex spectrum, can only be obtained from methods which employ single ion pulse counting.

A major limitation of the reflections designed to date is that focusing of product ions (mass resolution) is not constant over the mass range. Specifically, the selected precursor ion mass is generally the most well focused ion in the product ion mass spectrum, while focusing decreases for product ions with lower mass. This is generally attributed to the fact that lower mass product ions do not penetrate the reflectron to as great a depth as ions whose masses are close to the precursor ion mass. Thus, it has been a common observation that lowering the reflection voltages permits recording of the low mass portion of the spectrum with considerably better focus, while the higher mass ions simply pass through the back end of the reflectron.

For this reason, several investigators have suggested stepping the reflectron voltages to record different regions of the mass spectrum, or scanning the reflectron voltages and reconstructing a focused mass spectrum from a series of transients (Weinkauf, R.; Walter, K.; Weickhardt, C.; Boesl, U.; Schlag, E. W. *Int. J. Mass Spectrom. Ion Processes* Vol. 44a (1989) pp. 1219–25 and Spengler, B.; Kirsch, D.; Kaufmann, R.; Jaeger, E. *Rapid Commun. Mass Spectrom.* 6 (1992) pp. 105–08). For product ion mass spectra, this approach has the same disadvantages as the time-slice method employed by Wiley and McLaren, in that it does not realize the multiplex recording advantage of the time-of-flight mass spectrometer.

Although product ion mass spectra can be recorded in single TOF analyzers employing a reflectron, a number of investigators have described a variety of tandem configurations in which the first mass analyzer is utilized to select the precursor ion mass, while the second mass analyzer is used to record its product ion mass spectrum. Approaches using two linear TOF mass analyzers (i.e., without reflectrons) and reacceleration of the product ions have been described by Derrick (Jardine, D. R.; Morgan, J.; Alderdice, D. S.; Derrick, P. J.: *Org. Mass Spectrom.* Vol. 27 (1992) pp. 1077–83) and Cooks (Schey, K. L.; Cooks, R. G.; Grix, R; Wollnik, H., *International Journal of Mass Spectrometry and Ion Processes* Vol. 77 (1987) pp. 49–61).

A linear/reflectron (TOF/RTOF) configuration has also been reported by Cooks (Schey, K. L.; Cooks, R. G.; Kraft, A.; Grix, R.; Wollnik, H., *International Journal of Mass Spectrometry and Ion Processes* Vol. 94 (1989) pp. 1–14). Strobel and Russell (Strobel, F. H.; Solouki, T.; White, M. A.; Russell, D. H., *J. Am. Soc. Mass Spectrom.* Vol. 2 (1990) pp. 91–94); and (Strobel, F. H.; Preston, L. M.; Washburn, K. S.; Russell, D. H., *Anal. Chem.* Vol. 64 (1992) pp. 754–62) have recently described a hybrid instrument (EB/RTOF) using a double-focusing sector mass analyzer for mass selection and a reflectron TOF to record the product ions.

In addition, Cotter and Cornish (Cornish, T. J.; Cotter, R. J. *Analytical Chemistry* Vol. 65 (1993) pp. 1043–47) and (Cornish, T. J.; Cotter, R. J. *Org. Mass Spectrom.* (in press) have described a tandem (RTOF/RTOF) time-of-flight instrument using two reflecting time-of-flight mass analyzers. The first analyzer permits high resolution selection of the precursor ion by electronic gating prior to a collision cell, while the second mass analyzer is used to record the collision induced dissociation (CID) or product ion mass spectrum. In this instrument, both dual-stage and single-stage reflectrons have been used. However, both single and dual stage reflectrons currently used suffer from the focusing limitations described above.

The tandem time-of-flight mass spectrometer has several clear advantages over the reflectron TOF analyzer for recording of product ion mass spectra. In many instances, these advantages resemble the advantages of a four sector (EBEB) instrument over the linked E/B scanning methods employed on two sector (EB) mass spectrometers.

That is, the tandem time-of-flight permits high mass resolution selection of the precursor ion because electronic gating is accomplished as the ions are brought into time focus at the collision chamber. In contrast, ion mass gating in the first linear region ($L_1$) of a reflectron TOF is carried out prior to focusing by the reflectron. Secondly, the tandem time-of-flight mass spectrometer can more clearly separate metastable process from collision induced dissociation, since metastable ions occurring in the first field free region and traverse the first reflectron do not arrive at the ion mass gate at the same time.

SUMMARY OF THE INVENTION

An objective of the present invention is to provide a reflectron capable of focusing an entire mass range of product ions at substantially the same focal point without scanning the voltages of the lens plates of the reflectron. To achieve this objective, the reflectron of the present invention comprises a plurality of lens plates, each having an opening therein, for generating a non-linear electric field in the reflectron. To generate the non-linear electric field, the first lens plate having an opening through which the ions first enter the reflectron is set to a fixed potential, and the voltage applied to each successive lens plate increases non-linearly with respect to its preceding lens plate. That is, the voltage of the first lens plate is set to a low potential and the voltage being applied to each successive lens plate increases in a non-linear manner with the largest voltage being applied to the lens plate furthest from the first lens plate. This non-linear voltage application, to generate the non-linear electric field, can be achieved by coupling a potentiometer between each lens plate and adjusting each potentiometer accordingly. Alternatively, to generate the non-linear electric field, the lens plates may be unequally spaced and an equal voltage may be applied to each lens plate.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figure 1:
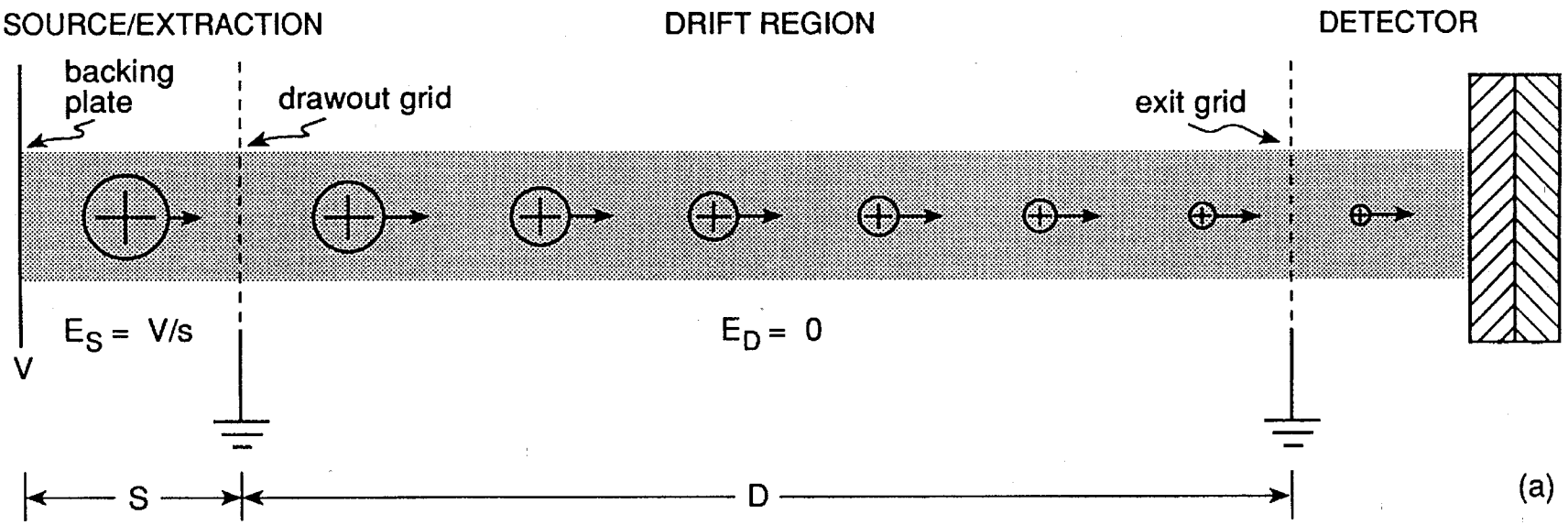
Fig. 1 (PRIOR ART)
FIG. 1 is a diagrammatic representation of a standard time-of-flight mass spectrometer.
Figure 2:
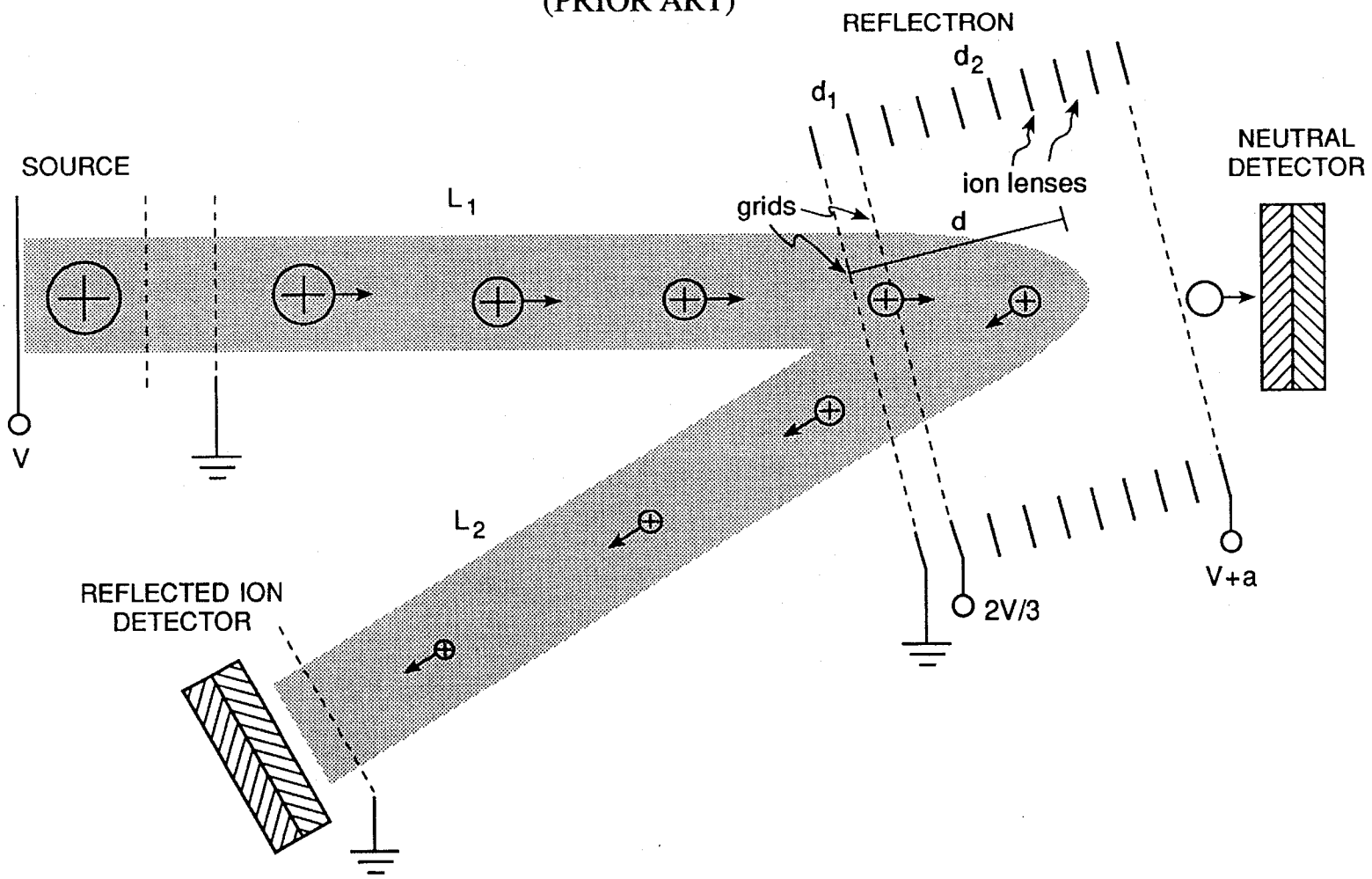
Fig. 2 (PRIOR ART)
FIG. 2 is a diagrammatic representation of a dual-stage linear field reflectron used with a time-of-flight mass spectrometer.
Figure 3:
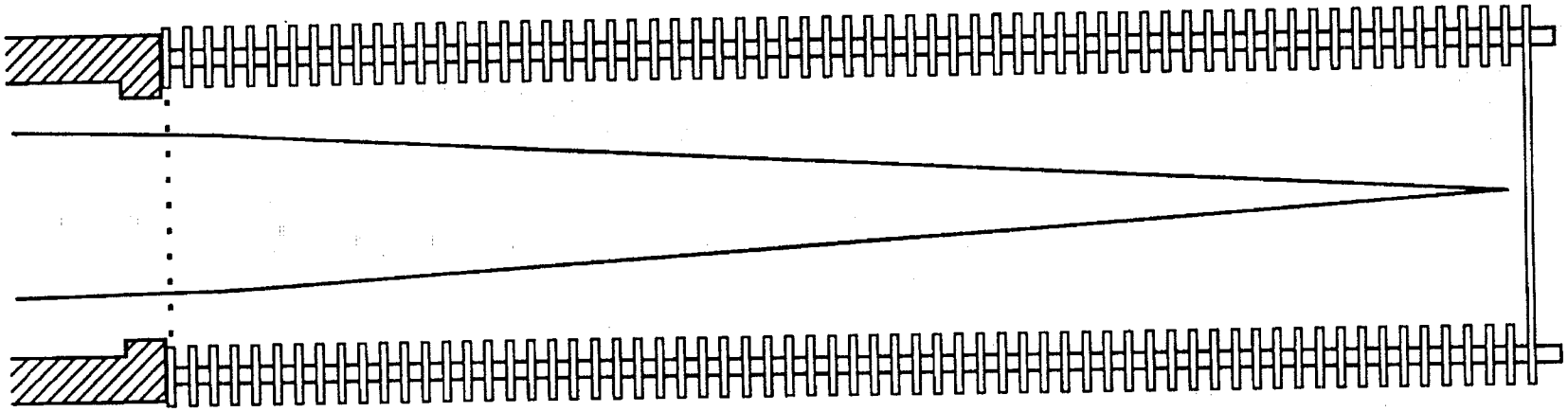
Fig. 3 (PRIOR ART)
FIG. 3 is a diagrammatic representation of a single stage linear field reflectron.
Figure 4:
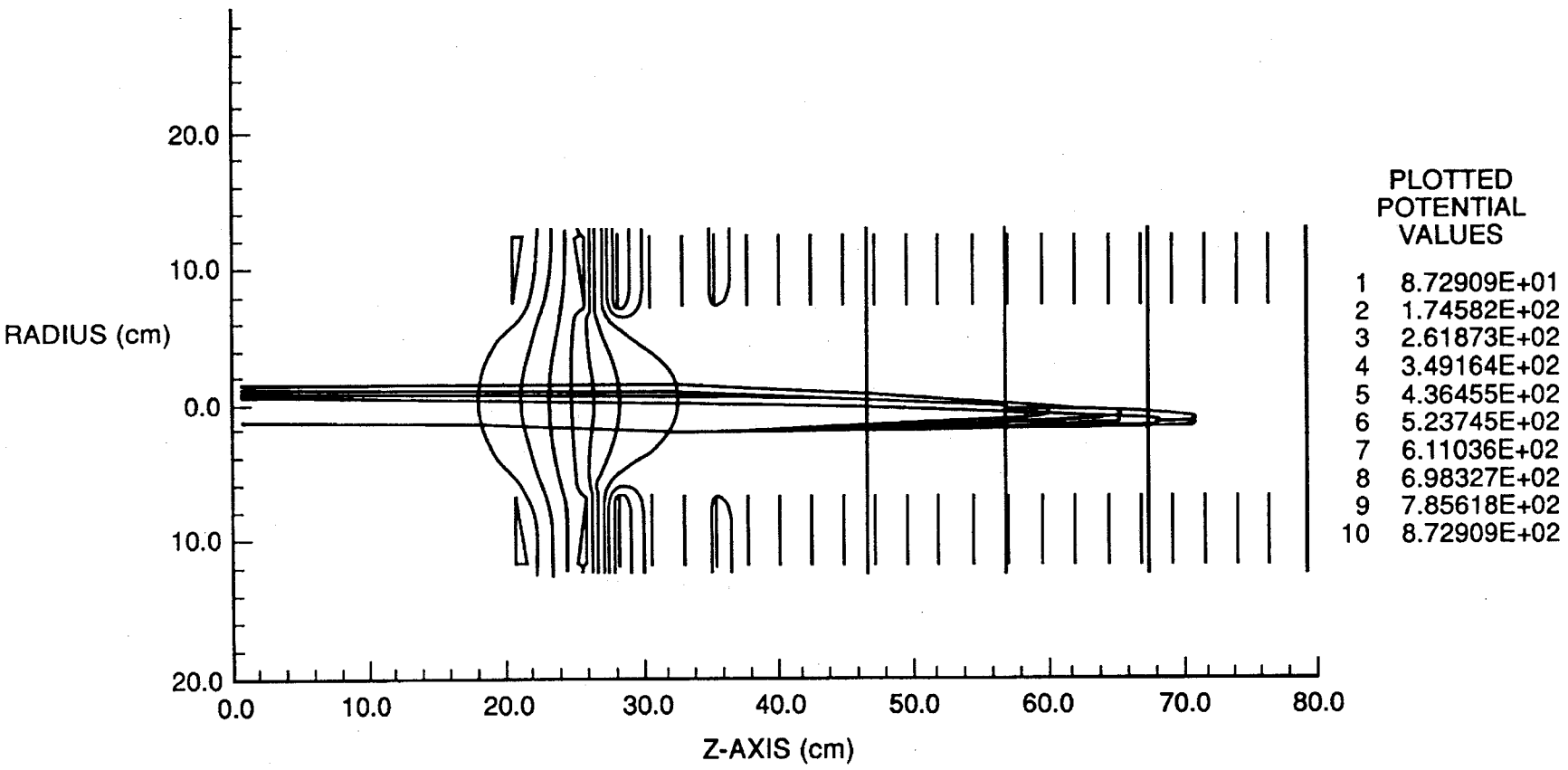
Fig. 4 (PRIOR ART)
FIG. 4 is a diagrammatic illustration of a gridless reflectron.
Figure 5:
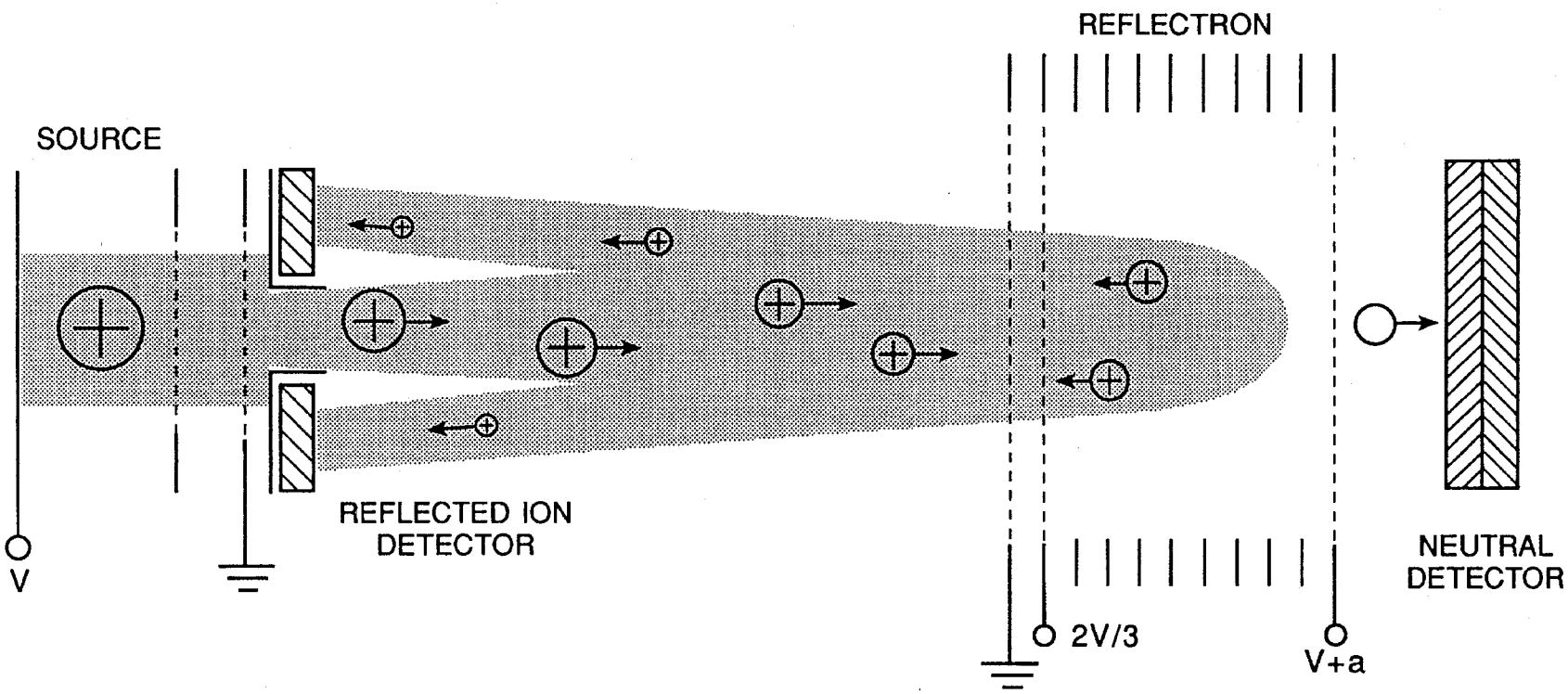
Fig. 5 (PRIOR ART)
FIG. 5 is a diagrammatic illustration of a coaxial reflectron.
Figure 6A:
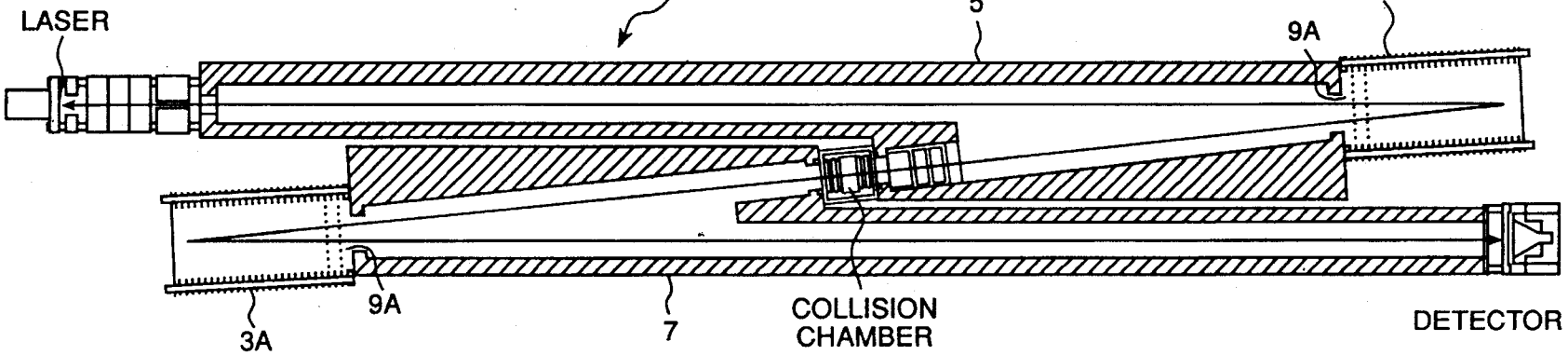
Fig. 6A (PRIOR ART)
FIG. 6A is a diagrammatic illustration of a tandem time-of-flight mass spectrometer using two single-stage linear field reflectrons.
Figure 6B:
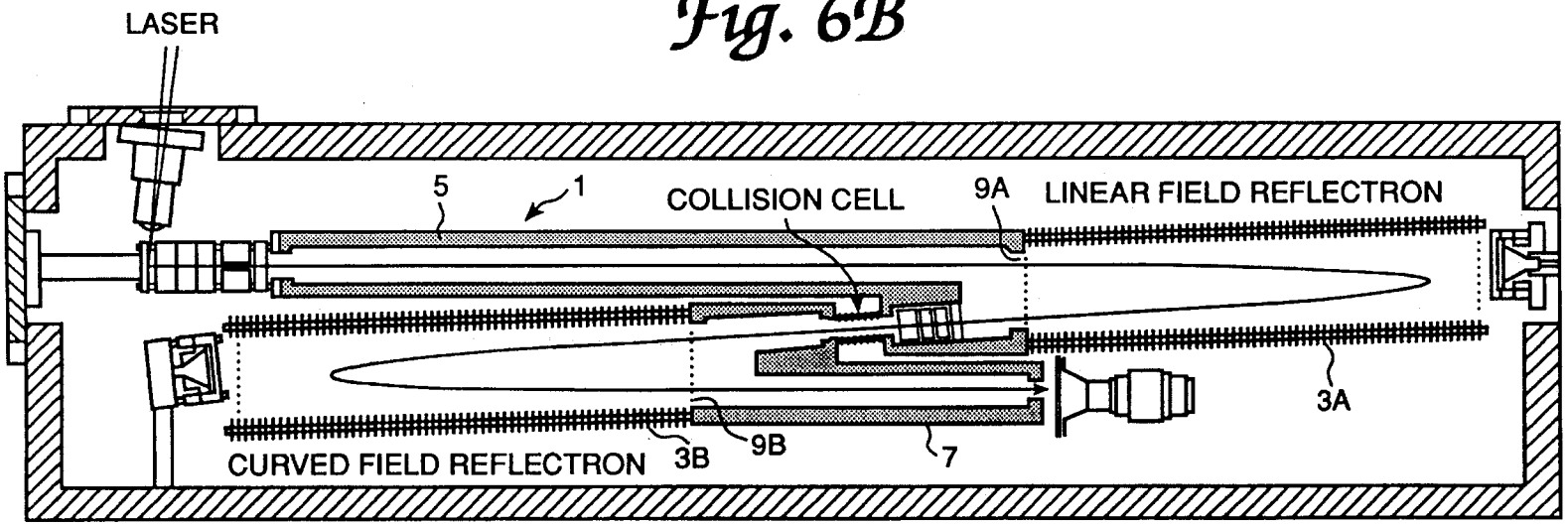
FIG. 6B is a diagrammatic illustration of a tandem time-of-flight mass spectrometer using a single-stage reflectron in the first mass analyzer and a non-linear field reflectron in the second mass analyzer.
Figure 7A:
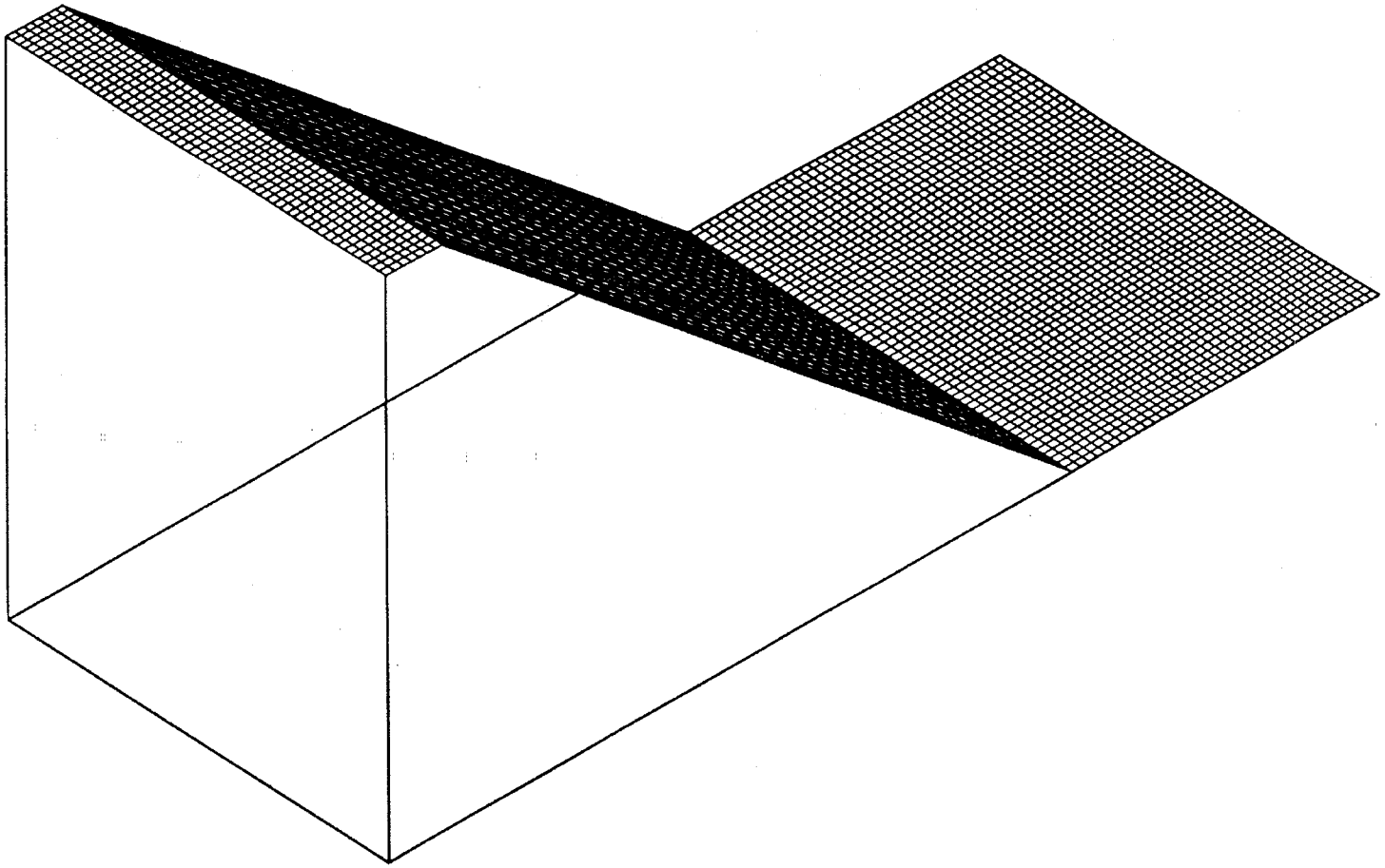
Fig. 7A (PRIOR ART)
FIG. 7A shows potential diagrams plotted by a SIMION (simulated ion trajectory calculation) program displaying voltages applied to a linear field single-stage reflectron.
Figure 7B:
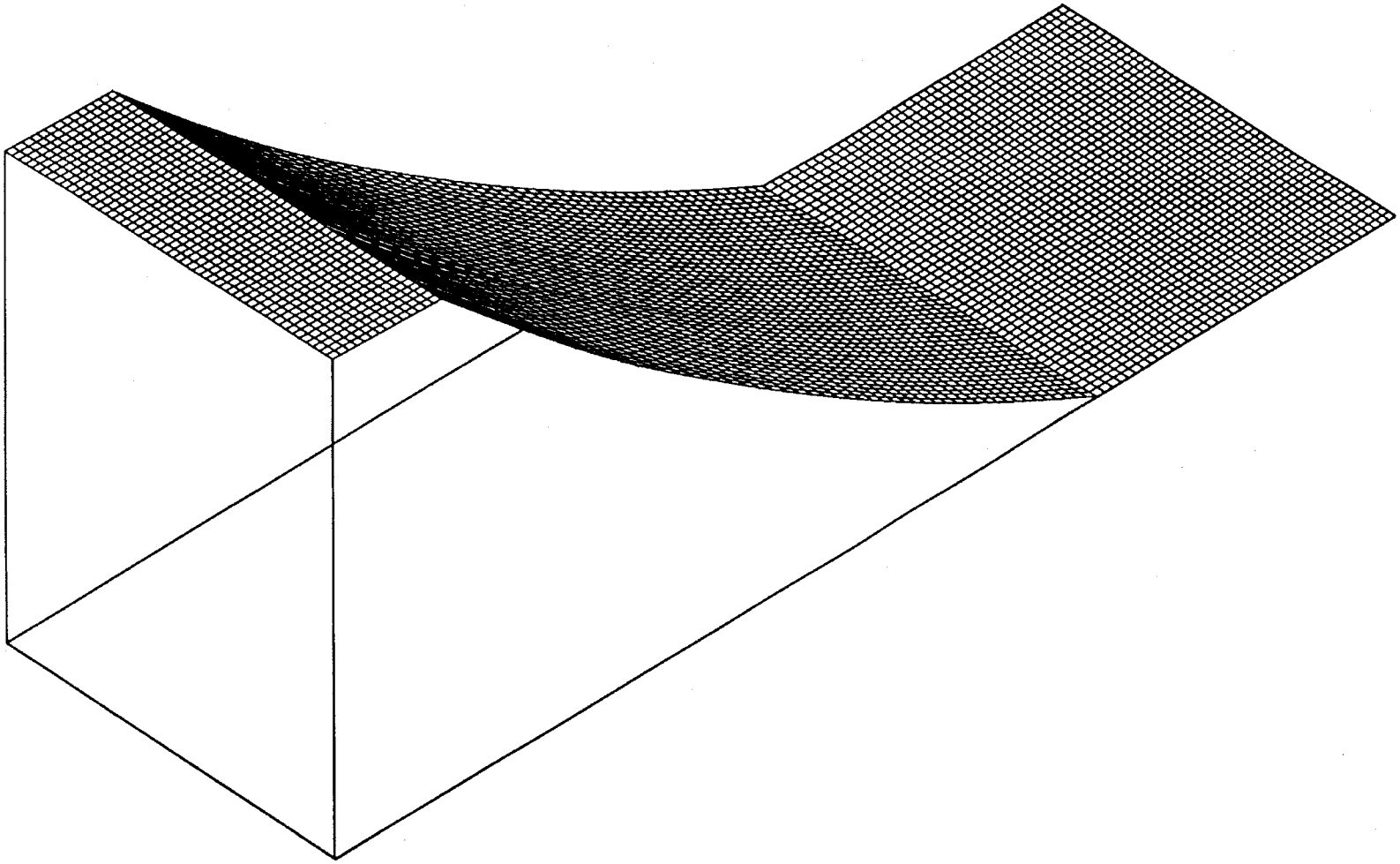
FIG. 7B shows potential diagrams plotted by a SIMION program displaying voltages applied to a non-linear field reflectron wherein the voltages were defined by the equation of a circle ($x^2+y^2=r^2$)

FIGS. 6A and 6B illustrate embodiments of a tandem time-of-flight mass spectrometer 1, using two single-stage linear field reflectrons 3A (FIG. 6A), and a single-stage linear field reflectron 3A in the first mass analyzer 5 and a non-linear field reflectron 3B in the second mass analyzer 7 (FIG. 6B). The ions enter and exit the openings 9A and 9B in the retarding lenses 11A and 11B of the linear and non-linear field reflectrons 3A and 3B, respectively. FIGS. 7A and 7B show potential diagrams plotted by the SIMION (simulated ion trajectory calculation) program that display the voltages placed on a linear field single-stage reflectron (FIG. 7A) and a non-linear field reflectron (FIG. 7B) where the voltages were defined by the equation of a circle ($x^2+y^2=r^2$, where y=voltage evaluated for lens x and r is a constant).

Figure 8A:
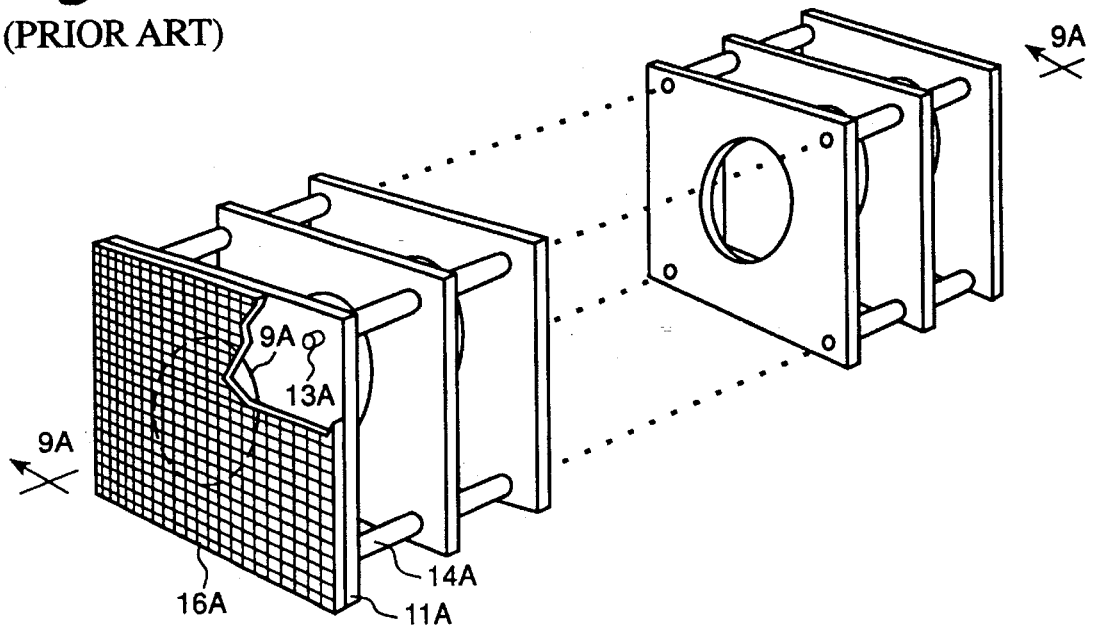
Fig. 8A (PRIOR ART)
FIG. 8A is a perspective view of a linear reflectron.
Figure 9A:
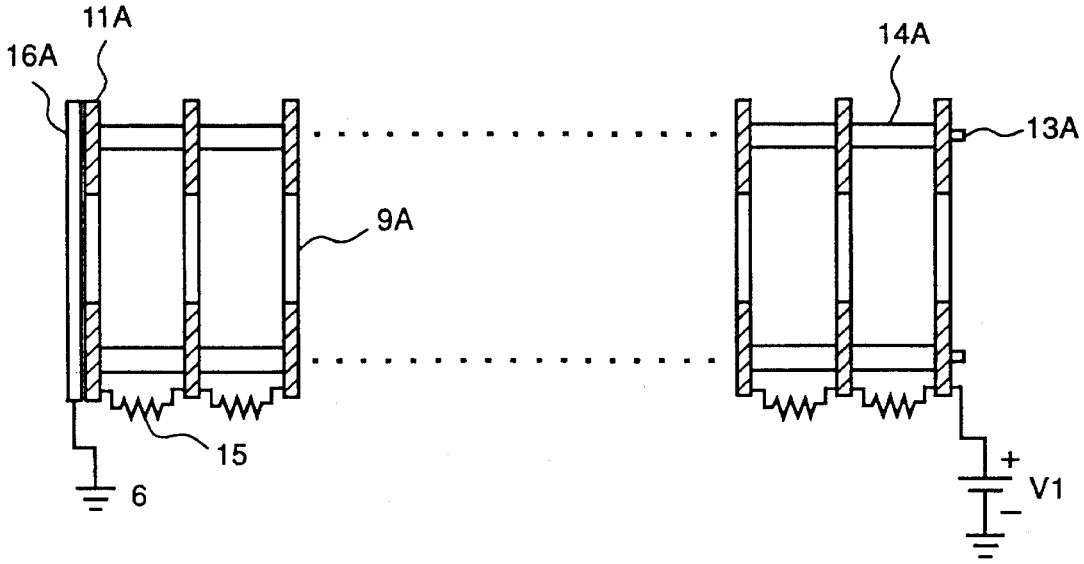
Fig. 9A (PRIOR ART)
FIG. 9A is a diagrammatic view of the linear reflectron of FIG. 8A taken along lines 9A—9A.

The linear reflectron 3A, as shown in FIGS. 8A and 9A, comprises a plurality of retarding lenses (lens plates) 11A. Mounting rods 13A and non-conducting spacers 14A made of ceramic or the like stack the lens plates 11A at substantially equal distances from their adjacent lens plates. Each of the lens plates 11A have holes 9A therein.

The voltages applied to the retarding lenses 11A are generally set by coupling fixed and identical resistors 15 between the lens plates 11A, coupling the final lens (or grid) 11A to a high voltage supply V1 and the entrance grid 16A to ground G.

Figure 8B:
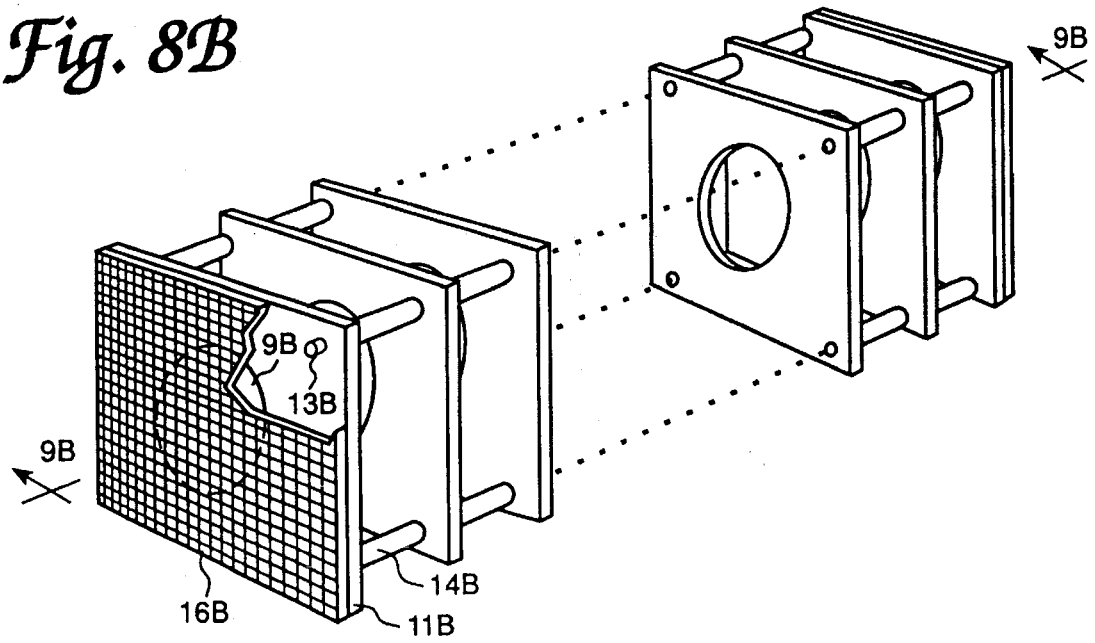
FIG. 8B is a perspective view of an embodiment of the non-linear reflectron of the present invention.
Figure 9B:
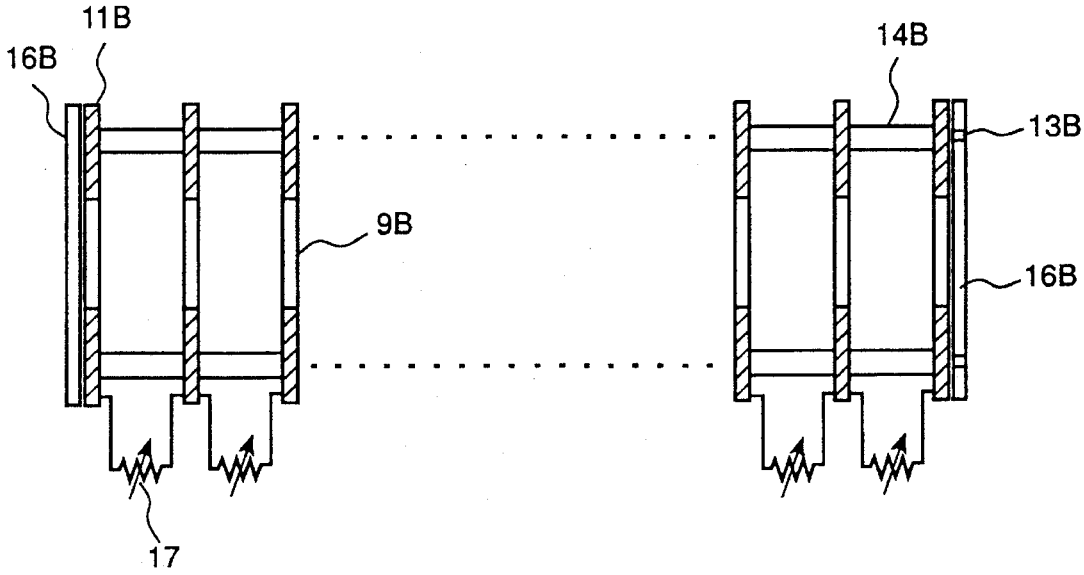
FIG. 9B is a diagrammatic view of the embodiment of the non-linear reflectron of the present invention of FIG. 8B taken along lines 9B—9B.

The nonlinear reflectron 3B, as shown in FIGS. 8B and 9B, has a configuration similar to the linear reflectron 3A in that the nonlinear reflectron 3B comprises a plurality of retarding lenses (lens plates) lIB. Mounting rods 13B and non-conducting spacers 14B, made of ceramic or the like, stack the lens plates lib at substantially equal distances from their adjacent lens plates. Each of the lens plates lib have holes 9B therein.

In this embodiment of the present invention, 66 retarding lens plates 11B are used to insure a smooth curved field, however, if desired, a larger or smaller number of lens plates can be used. The lens plates 11B are approximately 2,625 inches square, approximately 0.020 inches thick, and each have an approximately 2.0 diameter hole 9B therein. The lens plates are made of brass, but can be any conductive material such as stainless steel or the like. As described above, the lens plates 11B are stacked at substantially equal distances from their adjacent lens plates, and the overall length of the series of stacked lens plates 11B is approximately 9.5 inches. In this embodiment, the non-conducting spacers 14B are approximately 0.125 inches long, thus spacing the lens plates 11B at approximately 0.125 inches apart. Further, entrance and exit grids 16B are mounted over the holes 9B in the first and last lens plates 11B, respectively, to prevent the electric field generated by the voltage applied to the lens plates 11B, as described below, from penetrating the first and last lens plates lIB through their holes 9B. However, the plate configuration of the reflectron of the present invention can be any known configuration such as the gridless reflectron and coaxial reflectron configuration described previously.

In the reflectron of present invention, 2M ohm potentiometers 17 are coupled between the lenses 11B. The potentiometers 17 can be adjusted to achieve the required non-linear voltage distribution to generate the non-linear electric field. The voltage being applied to the lens plates lIB ranges from 0 to 4000 Volts DC, with 0 V (ground) being applied to the first lens plate lib and grid 16B attached thereto, through which the ions first enter the reflectron, and 4000 V being applied to the last lens plate 11B and grid 16B attached thereto. Of course, the minimum and maximum voltage potentials can vary by design choice.

Alternatively, instead of varying the voltage being applied to each lens plate, non-equally-spaced lens plates, having an equal voltage applied thereto, can be used to generate the non-linear electric field.

Figure 10A:
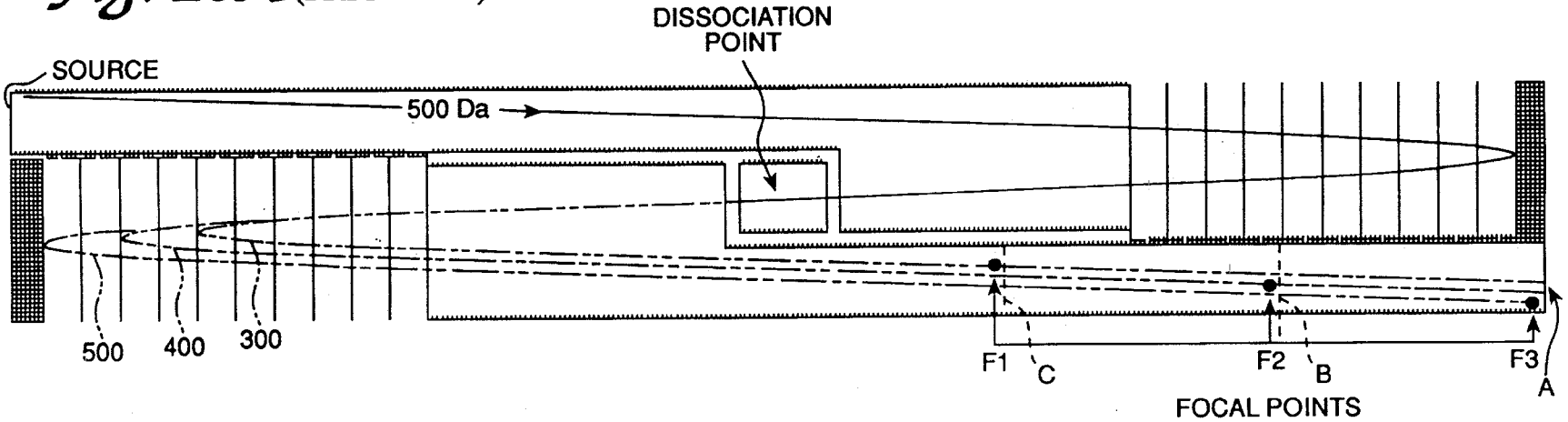
Fig. 10A (PRIOR ART)
FIG. 10A shows SIMION simulated trajectories of a precursor ion (formed in the ion source) having a ratio m/z of 500 Da and its product ions (formed at the dissociation point) having a ratio m/z of 400 Da and 300 Da, respectively, traveling in a tandem time-of-flight mass spectrometer employing linear reflectrons.

In FIG. 10A, as discussed above, the focal points for a precursor ion group having a mass/charge ratio m/z of 500 Da and its product ions having a ratio m/z of 400 Da and 300 Da are shown as F3, F2 and F1, respectively, as determined from SIMION simulated trajectories. That is, as shown in this diagram, the precursor and each of the product ions are focused at different locations. For a linear reflectron, this is a direct consequence of the fact that optimal focusing occurs when $L_1+L_2=4d$. As the penetration depth of product ions decreases, so does the length $L_2$ between the output of the reflectron and their focal points. Lowering the reflection voltage increases the penetration depth and moves the focal point of lower mass ions toward that of the precursor ion (where the detector is located), but, as we have noted, involves the acquisition of multiple scans to reconstruct a product ion mass spectrum that will have all mass regions in focus.

That is, to detect the ion groups (ions of a particular mass/charge ratio) in focus at their respective focal points, the detector should be positioned at that focal point. Hence, as shown in FIG. 10A, to detect the 400 Da ion group in focus, the detector should be positioned at focal point F2. Accordingly, the end of the flight tube should be at position B as shown by the phantom line. Similarly, to detect the 300 Da ion group in focus, the detector should be positioned at focal point F1. Accordingly, the end of the flight tube should be at position C as shown by the phantom line. However, such a method of detection would result in numerous flight tubes being used and thus be impractical.

Alternatively, by adjusting the voltage of the linear reflectron, the focal point of the 400 Da ion group could be moved from F2 to F3. Further, by re-adjusting the voltage of the reflectron, the focal point of the 300 Da ion group could be moved from F1 to F3. However, in this case, multiple experiments still need to be performed to detect the entire spectrum in focus.

For example, to begin, the reflectron would be set to a desired voltage, ions would be generated and the 500 Da group of ions would be detected in focus at F3. Then, the voltage of the reflectron would be adjusted to move the focal point F2 to F3, ions would be generated, and the 400 Da group of ions would be detected in focus at F3. 0f course, the 500 Da ion group would no longer be in focus at F3 but rather, if extrapolated, would be in focus at some position beyond F3. Then, the voltage of the reflectron would be adjusted to move the focal point F1 to F3, ions would be generated, and the 300 Da group of ions would be detected in focus at F3. Accordingly, both the 400 Da and 500 Da ion groups would be in focus at some position beyond F3.

Figure 10B:
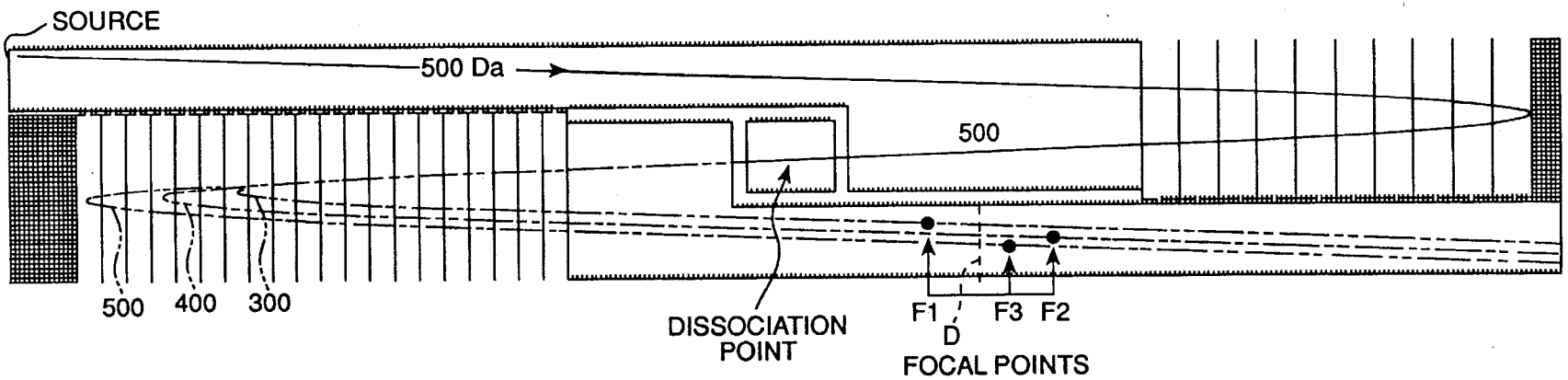
FIG. 10B shows SIMION simulated trajectories of a precursor ion (formed in the ion source) having a ratio m/z of 500 Da and its product ions (formed at the dissociation point) having a ratio m/z of 400 Da and 300 Da, respectively, traveling in a tandem time-of-flight mass spectrometer employing a linear reflectron in its first mass analyzer and a non-linear reflectron of the present invention in its second mass analyzer.

Alternatively, as shown in the simulated trajectory diagram of FIG. 10B, the reflectron of the present invention places the focal points along $L_2$ at the same or nearly the same location for product ions groups of all masses, so that the entire mass spectrum is substantially in focus for the same reflectron voltage arrangement and for each time-of-flight measurement cycle. This is achieved through the use of non-linear voltages, as simulated, for example, in FIG. 7B, which provide a steeper field toward the back end of the reflectron.

In FIG. 10B, the focal points F3, F2 and F1 for ion groups having ratios m/z of 500 Da, 400 Da and 300 Da, respectively, are shown for a reflectron in which the voltages of the lens plates were determined from the equation of a circle as shown in FIG. 7B. The focal points are considerably closer to one another, thus enabling one to record product ions over the entire mass range at high resolution from a detector located in the focal region.

In FIG. 10B, the positions of focal points F1–F3 are in a different order than the positions of focal points F1–F3 in FIG. 10A (i.e. F3 is to the left of F2 in FIG. 10B). This occurs because the non-linear electric field, as shown in FIG. 7B, which is generated by the voltage applied to the lens plates in accordance with the circle equation $x^2+y^2=r^2$, causes the focal points all to be within a particular region or window. That is, as shown in this example, as the mass/charge ratios for groups of ions increase to a certain level, the distances of the focal points from the reflectron increase. However, after reaching a maximum (e.g. when mass/charge ratio is 400 Da), the distances of the focal points from the reflectron for increasing mass/charge ratios decrease (e.g. 500 Da focal point closer to reflectron than 400 Da focal point). Thus, regardless of mass/charge ratios, all focal points are located at substantially the same location within a certain narrow region in the flight tube, with the region being defined by the equation governing the application of voltages to the lens plates. As described above, this narrow region allows a single detector to record product ions with much better focus than was previously possible. In this case, the end of the flight tube would essentially be at, for example, position D and the detector would be positioned at position D.

In addition, the equation used to determine the voltage of the lens plates can be, for example, a quadratic function. To date, several quadratic functions (for example: $y=x^2$ and $y=ax^2+b$, where y=voltage evaluated for lens x, and a and b are constants) have been tested using SIMION calculations. These give essentially equivalent results, that is, they result in compressing the focal region for the product ion mass range. To date, the circle equation discussed above has provided the best results. However, based on design choice of the reflectron and the lengths of the flight tubes, it is theoretically possible to derive a function which places the focal points all at exactly the same location.

Figure 11A:
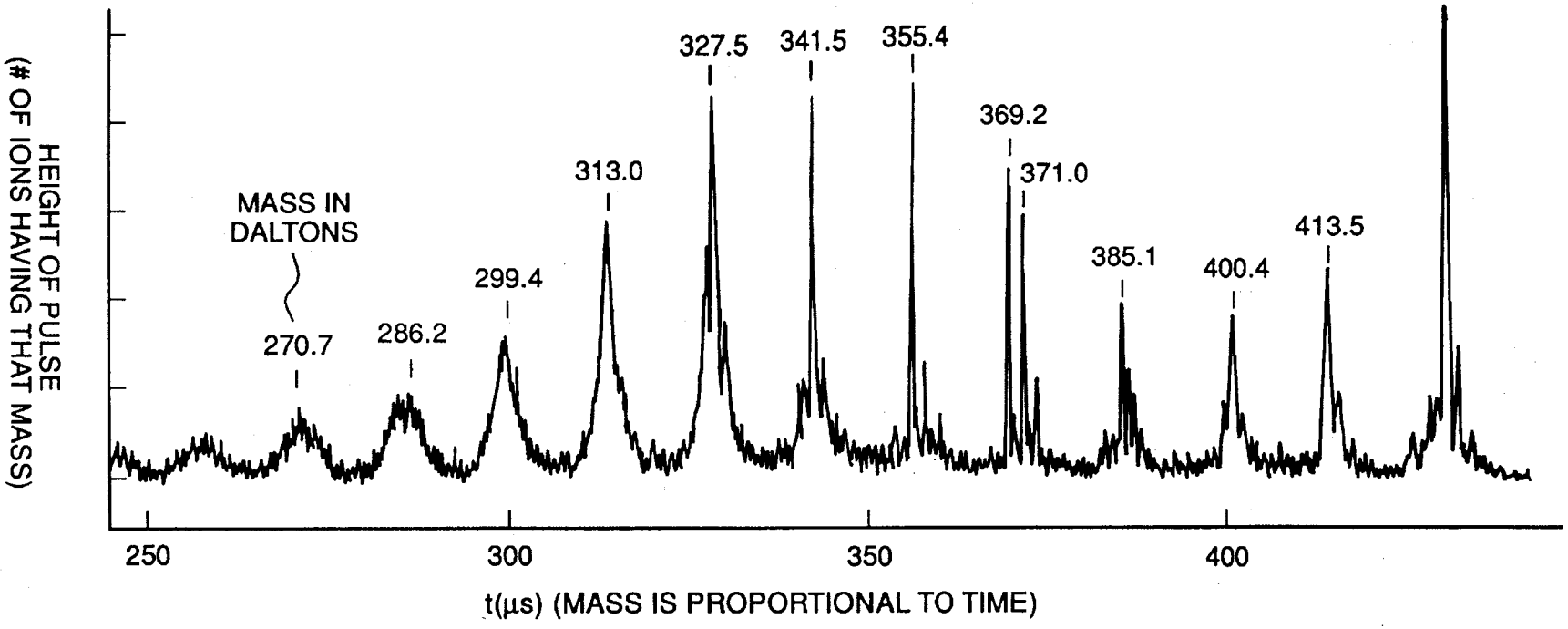
Fig. 11A (PRIOR ART)
FIG. 11A shows the product ion mass spectrum of the molecular ion of rhodamine obtained by collision with helium gas using single-stage, linear field reflectrons in both mass analyzers of a tandem time-of flight mass spectrometer as shown in FIG. 6A.
Figure 11B:
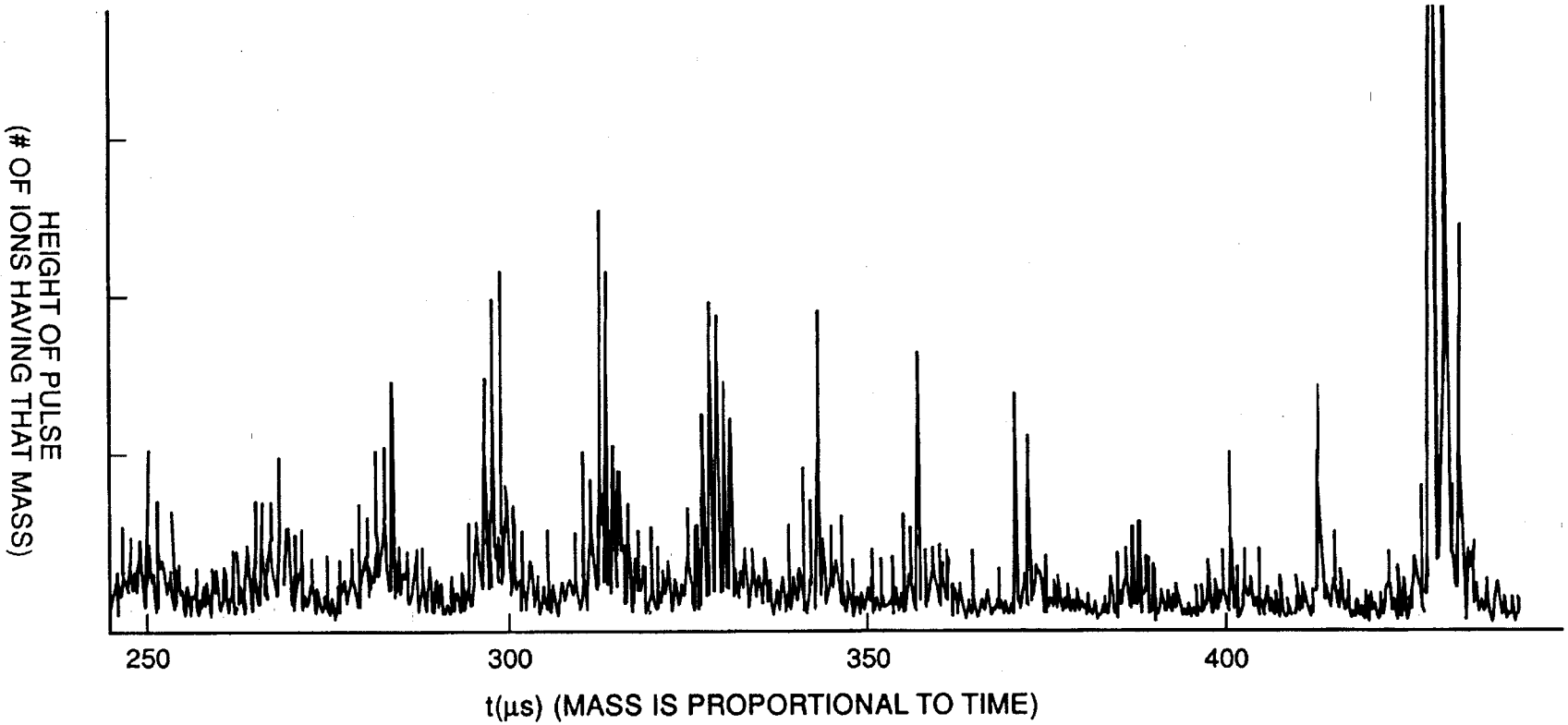
FIG. 11B shows the product ion mass spectrum of the molecular ion of rhodamine obtained by collision with helium gas using the non-linear reflectron of the present invention in the second mass analyzer of a tandem time-of-flight mass spectrometer as shown in FIG. 6B.

The non-linear reflectron has been implemented experimentally using the "arc of a circle" (circle equation as described above) voltage function on a tandem time-of-flight mass spectrometer employing two reflectrons (RTOF/RTOF). FIG. 11A shows the product ion mass spectrum of the molecular ion of rhodamine obtained by collision with helium gas using a single-stage, linear field reflectron. FIG. 11B, however, shows the product ion mass spectrum of the molecular ion of rhodamine obtained by collision with helium gas using the non-linear reflectron of the present invention in the second mass analyzer as shown, for example, in FIG. 6B.

In the spectrum utilizing the linear reflection, the reflectron voltages have been optimized for focusing the peaks at m/z 369 and 371, where the best resolution is observed. Resolution drops off considerably at lower mass (m/z 313 and below), where peaks differing by one mass unit are no longer distinguished. However, in the spectrum obtained using the non-linear field, the ions are in focus throughout the entire mass range, with a FWHM (full width at half maximum) resolution of approximately one part in 1000.

As described above, the non-linear reflectron of the present invention employs voltage values that produce a non-linear field, to compress the focal point range for product ions, and thus enabling multiplex recording of product ion mass spectra. Thus, simple modifications of existing reflectrons to achieve non-linear field focusing of product ions is within the scope of the present invention.

Finally, the mass dispersion and focusing behavior of a reflectron on a tandem time-of-flight mass spectrometer is identical to that on a single reflectron TOF instrument. Accordingly, the non-linear reflectron of the present invention, which has been implemented on a tandem time-of-flight mass spectrometer, will be equally advantageous for reflecting time-of-flight instruments.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A reflectron, for use with a mass spectrometer having at least one mass analyzer for receiving ions having various mass to charge ratios, comprising:

a plurality of lens plates, each having an opening therein for allowing said ions to pass therethrough, to which voltages are applied for generating an electric field, increasing non-linearly in a direction away from a first opening in a first lens plate of said plurality of lens plates through which said ions first pass when entering said reflectron, to cause said ions having various mass to charge ratios that enter said reflectron to focus at focus points outside of said reflectron having substantially the same location.

2. A reflectron as claimed in claim 1, wherein said lens plates are disposed adjacent to each other and substantially parallel to each other successively, and said voltages applied to said lens plates increase in a non-linear manner for each successively adjacent lens plate in a direction away from said first opening to cause said lens plates to generate said electric field.

3. A reflectron as claimed in claim 1, wherein:

said lens plates are disposed adjacent to each other and substantially parallel to each other; and said reflectron further comprises means for applying said voltages to said lens plates to cause said lens plates to generate said electric field, said voltages increase in a non-linear manner for each successively adjacent lens plate in a direction away from said first opening to cause said lens plates to generate said electric field.

4. A reflectron as claimed in claim 3, wherein said voltage applying means further comprises a plurality of variable resistors, each coupled between two successive said lens plates, for causing said voltages applied to said lens plates to increase in said non-linear manner.

5. A reflectron as claimed in claim 3, wherein said voltages applied to said lens plates are defined by the equation of a circle, $x^2+y^2=r^2$, where y=voltage evaluated for lens plate x and r is a constant.

6. A reflectron as claimed in claim 1, wherein said lens plates are disposed substantially parallel to each other at non-equal distances in a direction away from said first opening to cause said lens plates to generate said electric field.

7. A reflectron as claimed in claim 1, wherein said voltages are applied to said lens plates in accordance with a high order polynomial equation.

8. A reflectron as claimed in claim 7, wherein the locations of said focus points are based on said high order polynomial equation.

9. An apparatus for use with a reflectron having a plurality of successively adjacent lens plates each having an opening therein, comprising:

a voltage supply for applying voltages to said lens plates to generate an electric field, increasing non-linearly in a direction away from a first opening in a first lens plate of said plurality of lens plates.

10. An apparatus as claimed in claim 9, wherein said voltage supply applies said voltages to said lens plates in accordance with a high order polynomial equation.

11. An apparatus as claimed in claim 10, wherein said high order polynomial equation is $x^2+y^2=r^2$, where y=voltage evaluated for lens plate x and r is a constant.

12. An apparatus as claimed in claim 9, wherein said voltage supply applies said voltages to said lens plates in a non-linear manner for each successively adjacent lens plate in a direction away from said first opening to cause said lens plates to generate said electric field.

13. A method of using a reflectron, comprising a plurality of lens plates each having an opening therein, with a mass spectrometer having at least one mass analyzer, comprising the steps of:

receiving ions having various mass to charge ratios into said openings in said lens plates; and generating an electric field, increasing non-linearly in a direction away from a first opening in a first lens plate of said plurality of lens plates through which said ions first pass when entering said reflectron, to cause said ions having various mass to charge ratios that enter said reflectron to focus at focus points outside of said reflectron having substantially the same location.

14. A method as claimed in claim 13, further comprising the step of selecting a high order polynomial equation; and the location of said focus points are based on said high order polynomial equation.

15. A method as claimed in claim 14, wherein said high order polynomial equation is $x^2+y^2=r^2$, where y=voltage evaluated for lens plate x and r is a constant.

16. A method as claimed in claim 13, wherein said generating step comprises the step of applying voltages to said lens plates in an increasingly non-linear manner for each adjacent lens plate in a direction away from said first opening to cause said lens plates to generate said electric field.

17. A method as claimed in claim 16, further comprising the step of selecting a high order polynomial equation; and said applying step applies said voltages to said lens plates in accordance with said high order polynomial equation.

18. A method as claimed in claim 17, wherein said high order polynomial equation is $x^2+y^2=r^2$, where y=voltage evaluated for lens plate x and r is a constant.

* * * * *